US005337855A

United States Patent [19]

File

[11] Patent Number: 5,337,855

[45] Date of Patent: Aug. 16, 1994

[54] PORTABLE SUSPENSION DEVICE AND SYSTEM FOR SCAFFOLDING

[76] Inventor: Jonathan P. File, P.O. Box 1824, Kamuela, Hi. 96743

[21] Appl. No.: 62,912

[22] Filed: May 11, 1993

[51] Int. Cl.[5] ..... E04G 3/10

[52] U.S. Cl. ..... 182/150; 182/82

[58] Field of Search ..... 182/82, 150, 222; 248/228, 235

[56] References Cited

U.S. PATENT DOCUMENTS

| | | | |
|---|---|---|---|
| 1,558,425 | 10/1925 | Yetter . | |
| 2,882,101 | 4/1959 | Michalak et al. | 304/14 |
| 3,595,510 | 7/1971 | Hutchinson | 248/235 |
| 3,957,240 | 5/1976 | Johansson | 182/82 X |
| 4,122,916 | 10/1978 | Strobel | 182/82 |
| 4,452,336 | 6/1984 | Sickler | 182/82 |
| 4,673,060 | 6/1987 | Gregory | 182/82 |
| 4,957,185 | 9/1990 | Courchesne | 182/150 |
| 4,967,828 | 10/1990 | Duncan | 182/82 |

FOREIGN PATENT DOCUMENTS

| | | | |
|---|---|---|---|
| 3922722 | 1/1990 | Fed. Rep. of Germany | 182/150 |
| 1285490 | 12/1962 | France | 182/82 |
| 9106729 | 5/1991 | Norway | 182/150 |

*Primary Examiner*—Alvin C. Chin-Shue

*Attorney, Agent, or Firm*—Gunn, Lee & Miller

[57] ABSTRACT

A scaffolding device (10) having a base member (12). The base member (12) has compression strut (14) articulably mounted to base member (12) as well as a tension strut (20) which may be set either parallel to or perpendicular to the base member (12) with the tension strut (20) set parallel to the base member (12) and the compression strut ( 14).

19 Claims, 5 Drawing Sheets

PORTABLE SUSPENSION DEVICE AND SYSTEM FOR SCAFFOLDING

FIELD OF THE INVENTION

Portable invention device and system for scaffolding, more specifically a three-membered scaffolding device comprising a base member, compression strut and tension strut.

BACKGROUND

In constructing buildings, especially high-rise buildings, the scaffolding can be enormously expensive. It is bulky to transport to the construction site. In addition, it is expensive and time consuming to construct the scaffolding around the building. This is especially true for high rise buildings where scaffolding typically has to be built up from the ground and rise up as the building is completed. The need for additional scaffolding as high rise buildings are constructed from the ground up has led to the development of a number of scaffolding devices that are intended to be suspended from portions of the structure itself rather than supported from the ground.

The following U.S. patents disclose scaffolding devices which are suspended from the building structure itself rather than from the ground: U.S. Pat. Nos. 1,558,425; 2,882,101; 3,595,510; 4,122,916; 4,452,366; 4,673,060 and 4,957,185.

Some of the aforementioned patents disclose devices that lack portability. For example, U.S. Pat. No. 1,558,425 is not capable of being easily broken down and transported. Others, while foldable for easier transport, lack versatility in that they are configured only to support the worker adjacent a vertical post of the structure or to hang the worker suspended on the scaffolding from a pitched roof. For example, U.S. Pat. No. 2,882,101 discloses a scaffold bracket assembly designed to project laterally from vertically-oriented concrete forms. Moreover, the '101 patent discloses members that are foldable with respect to one another—that is, pivotally mounted one to the other.

None of the above-referenced patents, however, nor none of the prior art discloses a scaffolding device that is capable of being easily transported while being sufficiently versatile to either hang from a beam or rafter of the structure itself or to support itself laterally away from a vertical post comprising the structure itself.

Applicant provides a novel scaffolding device which combines the advantages of light weight, portability and versatility to provide for a scaffolding device which is capable of supporting a worker from the building structure itself rather than from the ground.

SUMMARY OF THE INVENTION

This and other objects are provided for in a scaffolding support device having a base member, compression strut and a tension strut, the tension strut and compression strut rotatably mounted to a base member such that the compression strut is attached either parallel or perpendicular to the base member.

DETAILED DESCRIPTION OF THE PREFERRED EMBODIMENTS

Figure 1:
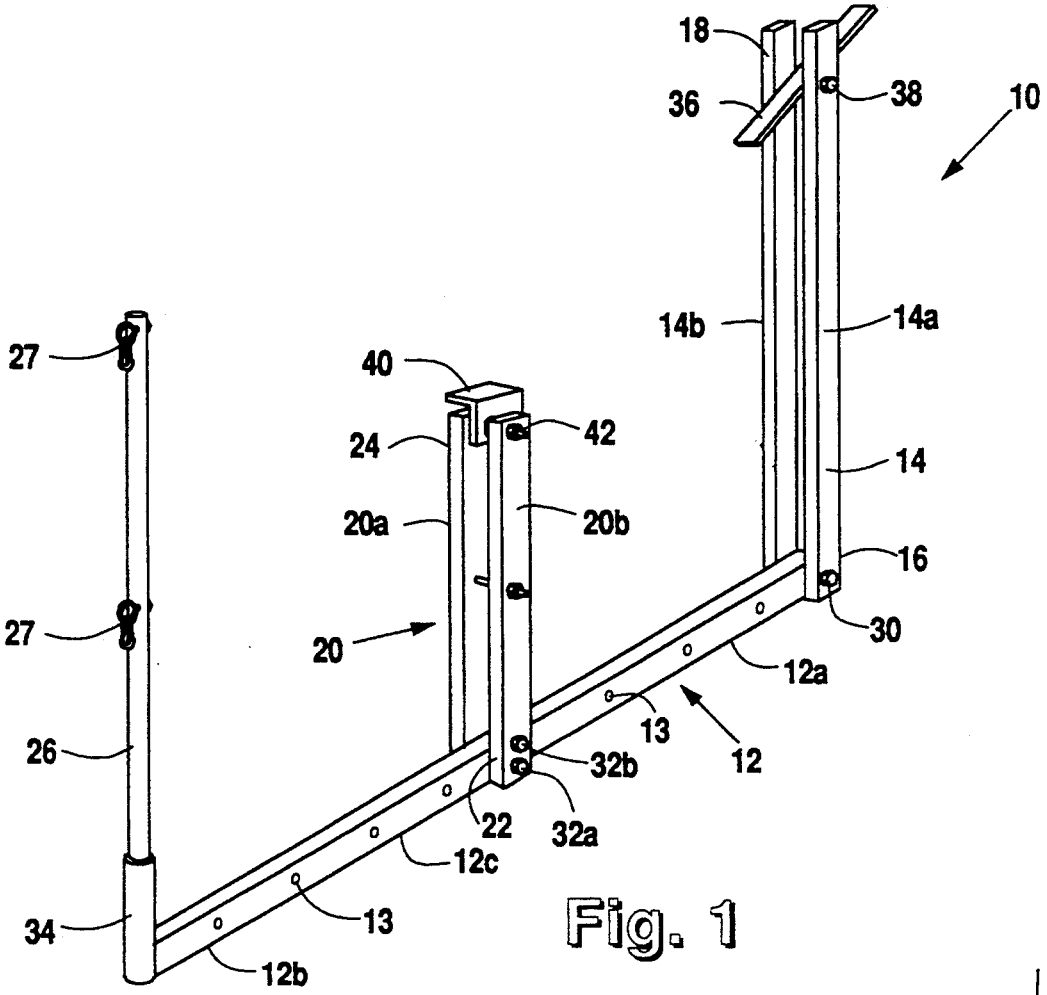
FIG. 1 is a perspective view of scaffolding device configured to hang from the eaves of a roof of a building structure.

FIG. 1 discloses scaffolding device (10) comprising a base beam (12), the base beam (12) having a near end (12*a*), a far end (12*b*) and a body (12*c*). Base beam (12) is typically aluminum and rectangular in cross-section. Numerous holes (13) are oriented perpendicular to the longitudinal access of base beam (12) at various points as more particularly set forth below.

As can be seen in FIG. 1, base beam (12) has attached at near end (12*a*), a compression strut (14). Compression strut (14) is comprised of two substantially identically-shaped rectangular cross-section aluminum members (14*a*) and (14*b*). Members (14*a*) and (14*b*) of compression strut (14) have a first or near end (16) and a second or removed end (18). In the configuration set forth in FIG. 1, wherein device (10) is configured to hang from the eaves of a flat or pitched roof, compression strut (14) is attached to near end (12*a*) so as to be perpendicular to base beam (12). Members (14*a*) and (14*b*) lie alongside base beam (12), attached thereto by fastening means (30).

FIG. 1 also illustrates tension strut (20) attached to body (12*c*) of base beam (12). More particularly, it is seen how tension strut (20) is comprised of first member (20*a*) and second member (20*b*), the members being substantially identical and rectangular in cross-section. Members (20*a*) and (20*b*) lie alongside base beam (12). Tension strut (20) is attached to body (12*c*) of base beam (12) at first or near end (22) as set forth in FIGS. 1 and 2, in a general perpendicular manner.

FIG. 1 also illustrates safety rail (26) seen here as projecting vertically from base beam (12) and functioning to attach safety ropes to clips (27) such that ropes are strung from rail to rail to prevent a worker standing on planks or boards suspended between devices (10) from falling off. Socket means (34) located at far end (12*b*) of base beam (12) allows safety rail (26) to be insertably removed from base beam (12).

Turning now to the details of scaffolding device (10), it can be seen that near end (12*a*) of base beam (12) is attached to compression strut (14) at first end (16) thereof. Fastening means (32*a*) and (32*b*), typically comprising a suitably dimensioned nut and bolt and bushed holes in the base beam and strut, are used to fasten first end (22*a*) of tension strut (22), body (12*c*) of base beam (12).

Compression strut bracket (36) is located at second end (18) of compression strut (14) between members (14*a*) and (14*b*). Tension strut bracket (40) is located at second end (24) of tension strut (20) between tension strut members (20*a*) and (20*b*).

Figure 2:
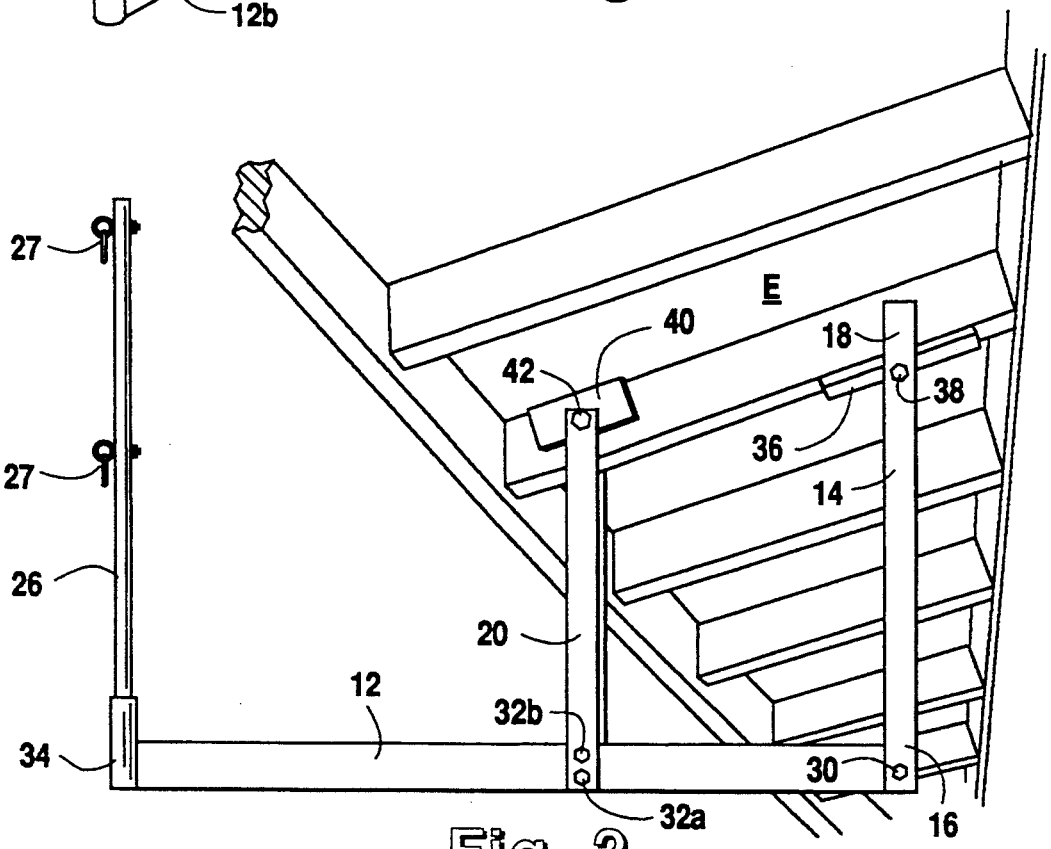
FIG. 2 is an illustration in perspective of the scaffolding device hanging from the eaves of the building structure.

Turning now to FIG. 2, it can be seen that FIG. 2 shows the manner in which device (10) may be suspended to hang vertically from the flat or pitched eaves of a roof. It is seen that when device (10) is configured to be used to hang from the eaves of a roof, both compression strut (14) and tension strut (20) project vertically from horizontal base beam (12). More particularly, compression strut (14) is located at near end (12*a*) and projects vertically upward with members of (14*a*) and (14*b*) laying alongside of the roof rafter with compression strut bracket (36) laying along the underside of the rafter. Tension strut (20) projects vertically from base member (12) with tension strut bracket (40) engaging the top surface of the rafter. Fastening means (42) allows tension strut bracket (40) to pivotally mount to second end (24) of tension strut (20). It is further noted that fastening means (32*a*) and (32*b*) provide positive vertical alignment such that tension strut (20) is not rotatable about base beam (12). Thus, body (12*c*) of base beam (12) typically has at least one set of two bushed holes (13), aligned perpendicular to axis of beam (12) for receipt of fastening means (32*a*) and (32*b*). Safety rail (26) trends vertically from far end (12*b*) of base beam (12) to protect workers from falling off the scaffolding.

Figure 3:
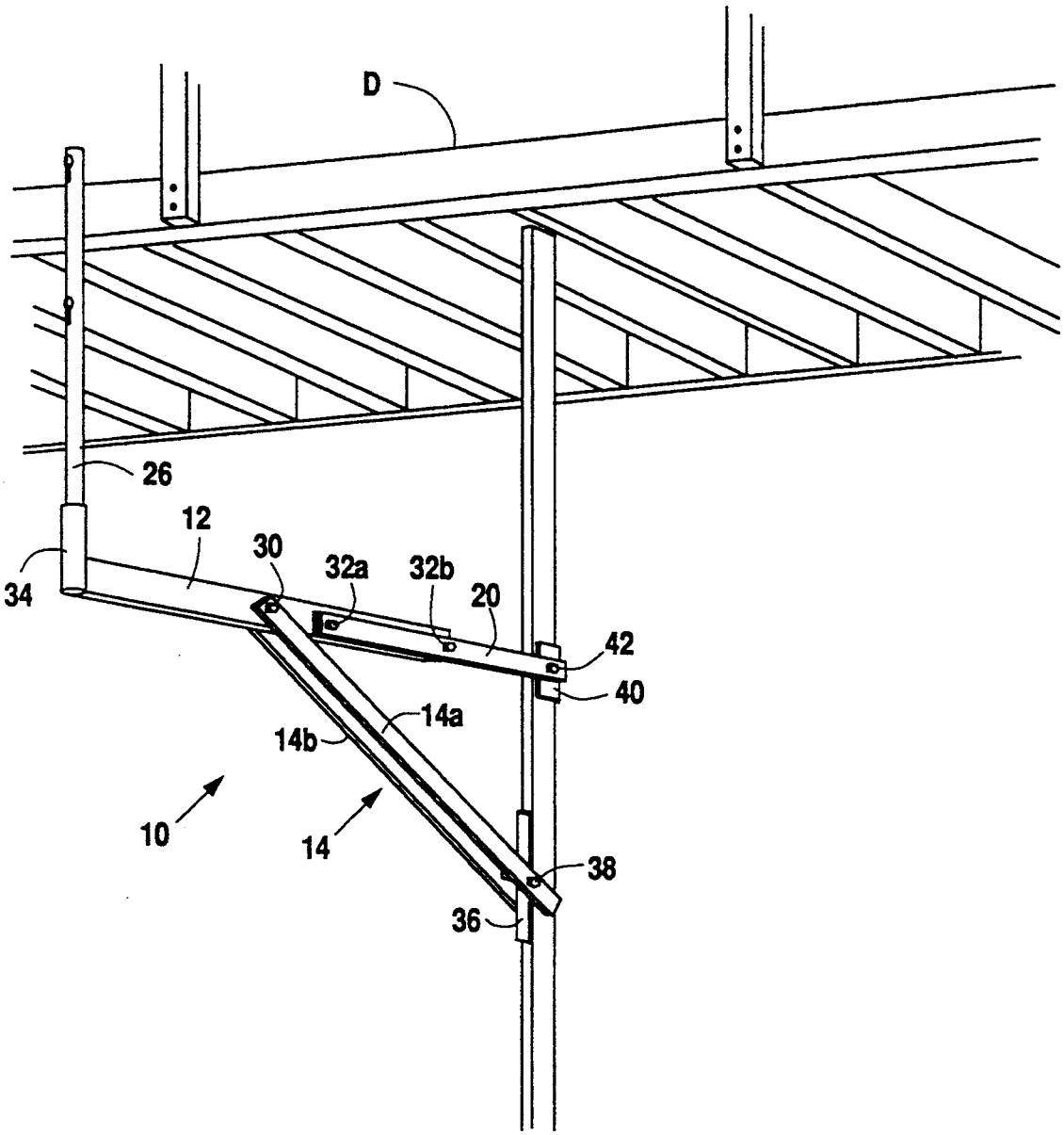
FIG. 3 is the scaffolding device in perspective view suspended laterally from a support beam of the building structure.

FIG. 3 illustrates device (10) configured to support the worker in a position lateral to a vertical post or a stud of the structure. More specifically, FIG. 3 illustrates device (12) configured so tension strut (20) lies coincident with a longitudinal access of base beam (12) and provides an extension thereof. Fastening means (32*a*) and (32*b*) are now spaced apart so as to hold tension strut (20) in horizontal alignment with base beam (12) so tension strut bracket (40) may hook around a removed vertical face of the support post. Compression strut (14) is attached at first end (16) to body (12*c*) of base beam (12). Compression strut (14) is preferably attached such that it makes about a 45° interior angle with base beam (12). In this position, second end (18) of compression strut (14) will straddle the sides of the support post and compression strut bracket (36) will lay on a near face of the support post.

Thus, it is seen how device (10) may provide for scaffolding either suspended from rafters or eaves as set forth in FIG. 2, or from a vertical post as set forth in FIG. 3. In either embodiment, it is to be appreciated that compression strut (14) is loaded primarily with compressive forces and that tension strut (20) is loaded primarily with tensile forces. The shear loadings that both compression strut (14) and tension strut (20) exert on the beams which support scaffolding device (20) as set forth in FIGS. 2 and 3 are materially less than the compression and tension forces.

Figure 4:
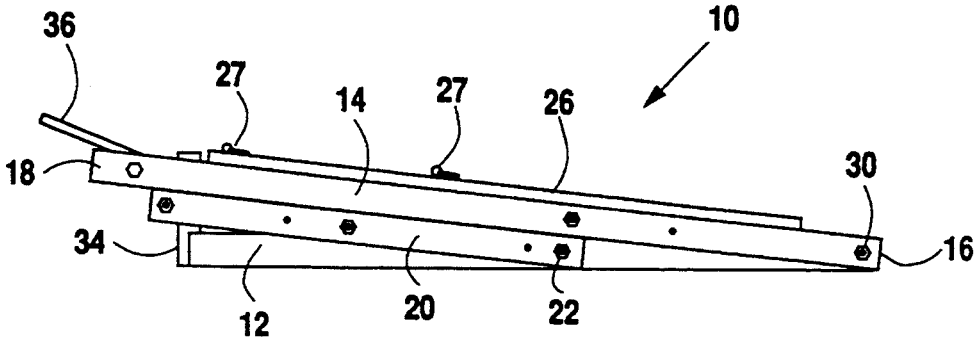
FIG. 4 is a view of the scaffolding device in perspective, broken down for storage and transportation.

FIG. 4 illustrates device (10) broken down for convenient and easy transport and storage. In this configuration, it can be seen that compression strut (14) and tension strut (20) both utilize fastener means which allow pivoting of the struts with respect to base beam (12) such that they can lie in a generally parallel arrangement. The safety rail is detachable as illustrated in FIG. 4 to lie parallel with the rest of the mechanism. Thus, they can be easily stored or stacked in the back of a truck for easy transportation.

Base member (12), compression strut (14) and tension strut (20) are typically made of rectangular cross-sectioned aluminum, with the safety rail being round aluminum tubing. If aluminum is used, bushings should be used where bolts go through to prevent wear at the bolt holes.

Figure 5A:
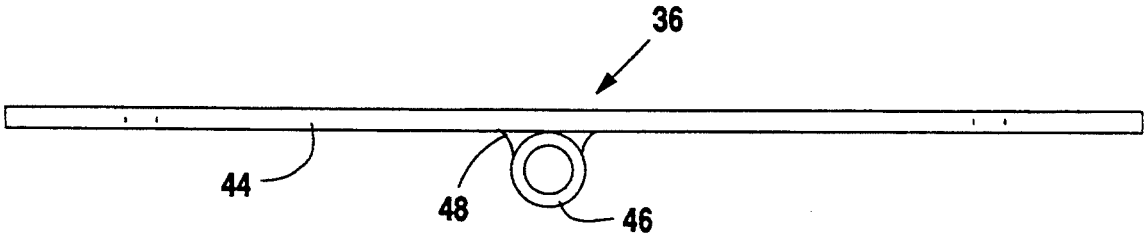
FIGS. 5*a*, 5*b* and 5*c* represent side, top and front elevational views respectively of the compression strut bracket of Applicant's scaffolding device.
Figure 5B:
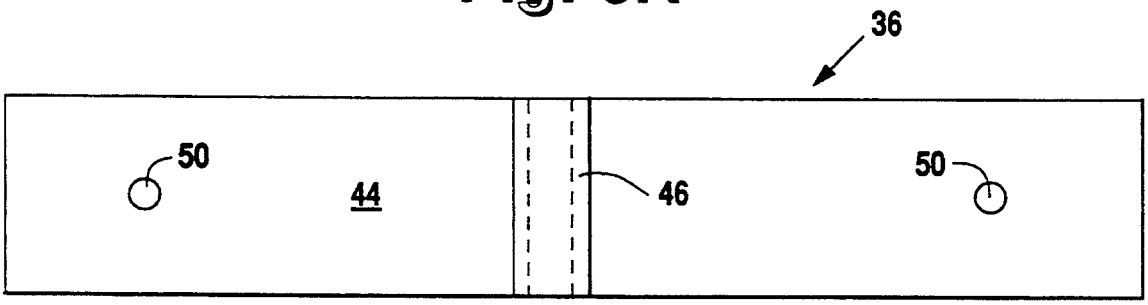
Figure 5C:
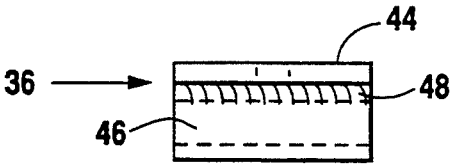

FIGS. 5*a*, 5*b* and 5*c* illustrate side, top and elevational views of the compression strut bracket (36). Specifically, compression strut bracket (36) is seen to comprise generally rectangular plate (44), typically made of steel and 1½" wide (for use with 2×4 support beams), 11 inches long and ½-inch thick. Plate (44) has centrally attached thereto and running perpendicular to longitudinal axis a lug or channel (46) attached thereto by weld (48). Lug or channel (46) is typically 5/16-inch in interior diameter so to accept fastening means (38)—typically a 5/16-inch grade 8 or aircraft quality bolt. It can be seen that plate (44) also has nail holes (50) located on the removed ends thereof. Nails will be driven through plate (44) when device (10) is in use to help stabilize compression strut (14) as well as to prevent shear forces from moving the strut. Moreover, it is seen how using a 5/16-inch bolt through holes (13) with fastening means (38) at second end (18) of compression strut (14) in conjunction with lug or channel (46) of plate 44 will allow compression strut (36) to rotate or articulate and so adjust to various angles.

Figure 6A:
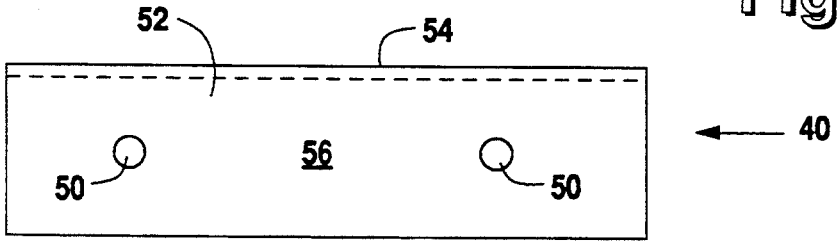
FIGS. 6*a*, 6*b* and 6*c* represent side, top and front elevational views respectively of the tension strut bracket of Applicant's scaffolding device.
Figure 6B:
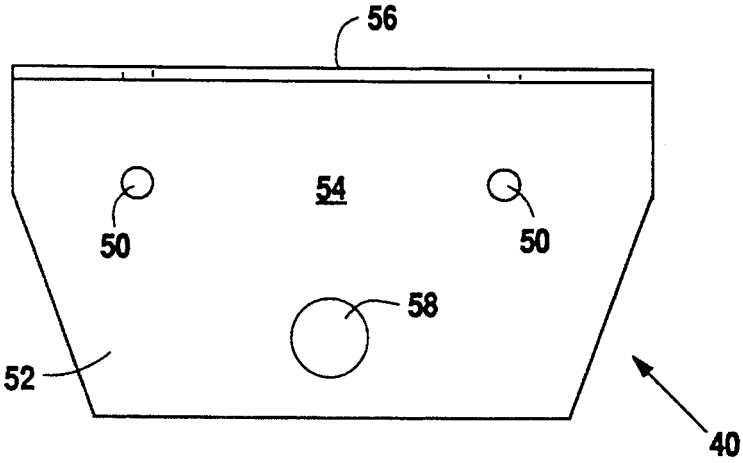
Figure 6C:
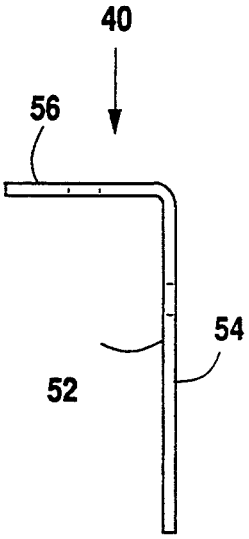

FIGS. 6*a*, 6*b* and 6*c* represent side, top and end elevational views of tension strut bracket (40). More specifically it is seen how compression strut bracket (40) is comprised generally of L-shaped plate (52), typically 6 inches long, having leg (54) and flat foot (56). Typically, foot portion is 1½" wide (for use with a 2×4 support beam). Foot portion (56) is flat so as to easily slip between roof decking and support beam as seen more specifically in FIG. 2. It is also seen how foot portion (56) and leg (54) contain nail holes (50) therein to help stabilize tension strut bracket (40) to support beam and prevent movement influenced by shear loading. It is also seen how plate (52) has bolt hole (58) therein to accept a bolt—typically a ⅜-inch to 5/16-inch grade 8 or aircraft quality bolt comprising fastening means (42). That is, fastening means (42) comprises a bolt slidably engaged within a bushed bolt hole at second end (24) of tension strut (20) which is designed to go through bolt hole (58) of plate (52) to rotatably secure tension strut bracket (42) to tension strut (20)—either member (14*a*) or (14*b*) thereof.

Figure 7A:
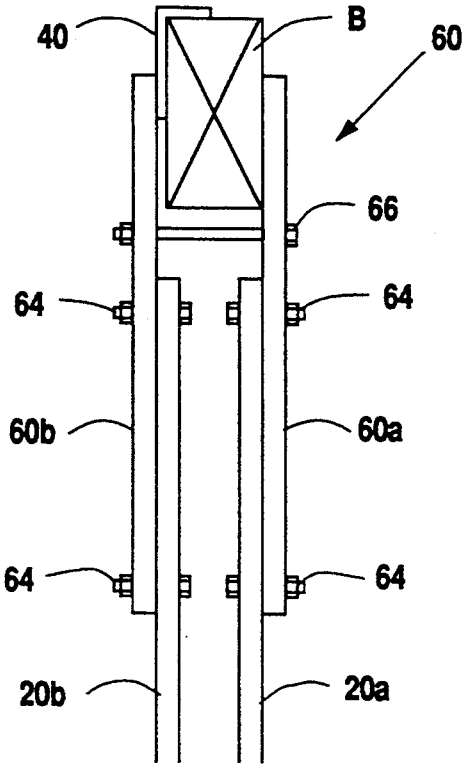
FIGS. 7*a* and 7*b* represent the scaffolding device with adapters to fit four-inch-wide rafters.
Figure 7B:
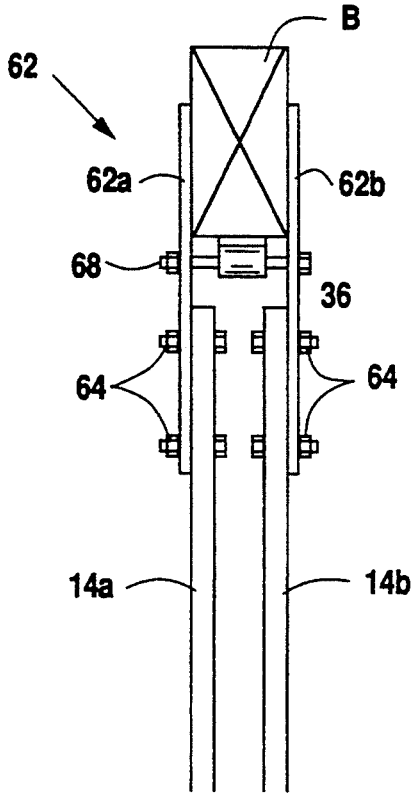

Typically the support beams on which device (10) is affixed are 2×4, 2×6, 2×8, 2×10, etc. These typically have a thickness or width of about 1½ inches. Thus, members (14*a*) and (14*b*) of compression strut (14), as well as members (20*a*) and (20*b*) of tension strut (20), have inside walls that are typically 1½ inches apart. Likewise, the width of compression strut bracket (36) and tension strut bracket (40) is typically 1½ inches. However, sometimes "four by" beams are used, or support beams comprised of two 2×4s, 2×6s, 2×8s, 2×10s, etc., nailed together. These, of course, provide a very strong support on which to attach scaffolding device (10). For using support beams of widths greater than about 2 inches, Applicant has provided modifications in the form of adapter brackets (60) and (62) as seen in FIGS. 7*a* and 7*b*, respectively. Both adapter brackets are similarly constructed, being comprised of extension members (60*a*) and (60*b*) and extension members (62*a*) and (62*b*) respectively. Fastening means such as 5/16-inch bolts are provided to attached members (60*a*), (60*b*), (62*a*) and (62*b*) to the outside surfaces of members (20*a*) and (20*b*), and (14*a*) and (14*b*), respectively. It should be noted that means such as long bolt (66) in FIG. 7*a* may be provided to help stabilize extension (60*a*) and (60*b*) with respect to one another, and prevent outward movement thereof. Tension strut bracket (40) may be located on either extension (60*a*) or (60*b*).

Compression strut bracket (36) is supported between extension (62*a*) and (62*b*) as illustrated in FIG. 7*b*. More specifically, FIG. 7*b* illustrates long bolt (68) supporting compression strut bracket (36) between extensions (62*a*) and (62*b*). Either a single 1½ inch wide tension strut support bracket may be used on the underside of 4×8 beam or, for additional support, two tension strut brackets (both 1½ inches wide, thus almost completely covering the 4 "by" support beam undersurface) maybe used.

Figure 8A:
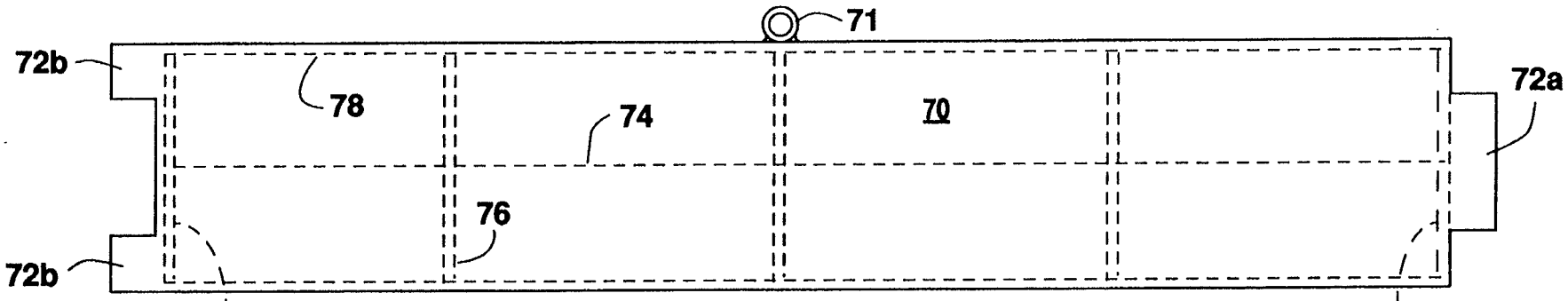
FIGS. 8*a* and 8*b* represent details of an aluminum plank of Applicant's present invention.
Figure 8B:
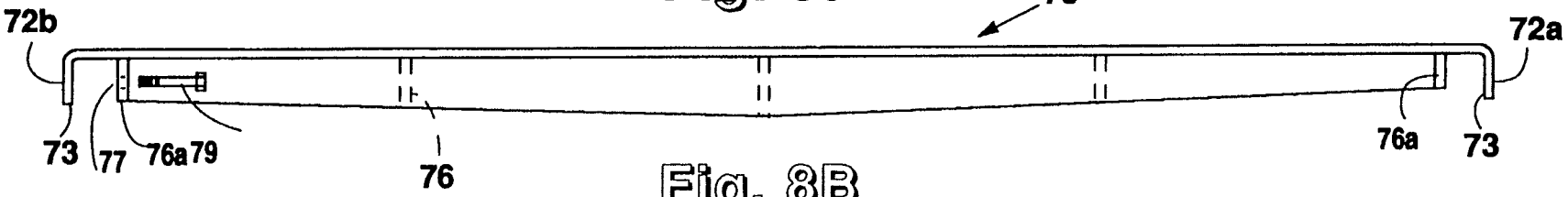

FIGS. 8*a* and 8*b* illustrate two views of the aluminum plank of scaffolding device (10) of Applicant's present invention. As can be seen in FIGS. 8*a* and 8*b*, aluminum plank (70) is generally rectangular and comes in 4-, 8- or 16-foot lengths. Plank (70) has central channel brackets (72*a*) at one end thereof. Lengths greater than 8 ft. should have safety rail sockets (71), to provide means for attaching safety rail (26) directly to plank (70) such as when there is more than 8 ft. between adjacent devices (10). At the opposite end thereof are outboard channel brackets (72*b*). Longitudinal central support rib (74) is located on the underside of top surface (78). Cross braces (76) trend perpendicular to rib (74). Combined actions of members (74) and (76) provide additional rigidity to top surface (78). Note also end cross braces (76*a*) which lie adjacent central and outboard channel brackets (72*a*) and (72*b*). These brackets contain fastening means comprised of hole (77) and locking pin (79). When plank (70) is placed on base member (12), hole (77) aligns with one of holes (13) in base member (12) to prevent plank (70) from flipping off device (10) when a worker falls against safety rail (26) anchored in socket (71).

Figure 9:
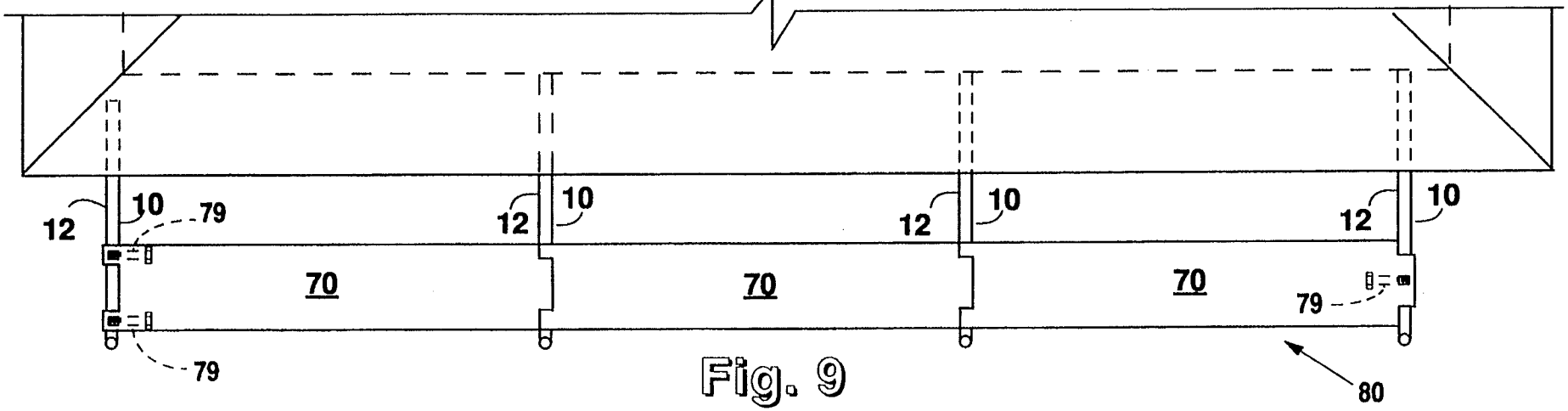
FIG. 9 represents Applicant's system as attached to a building structure.

FIG. 9 illustrates Applicant's device (10) used along with plank (70), defining system (80) as used on a building. More specifically, FIG. 9 illustrates use of scaffolding device (10) with planks (70) laid end-to-end across base members (12) such that both brackets (72*a*) and (72*b*) securely fit with legs (73) fitting snugly against the side walls of base member (12) and thereby preventing plank (70) from slipping side-to-side. FIG. 9 also illustrates how brackets (72*a*) and (72*b*) are designed to fit such that (72*a*) lies within (72*b*) to help prevent planks (70) sliding along base member (12) or from sliding out of alignment, one to the other. That is, FIG. 9 illustrates how brackets (72*a*) and (72*b*) work together to maintain the straight alignment of the planks across base members (12). Last, it may be seen how pin (79) fastens system together.

Figure 10A:
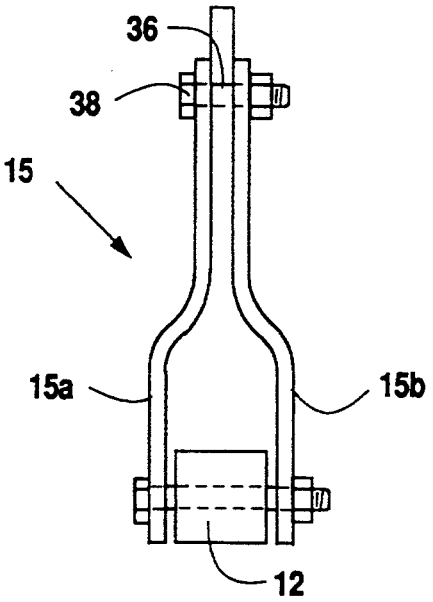
FIGS. 10*a* and 10*b* represent alternate preferred embodiments of Applicant's struts.
Figure 10B:
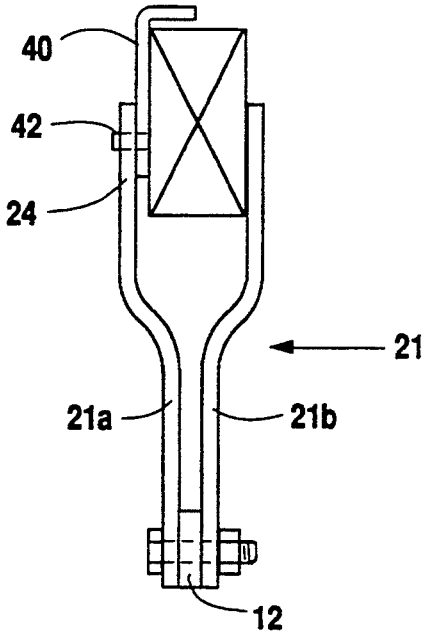

FIGS. 10*a* and 10*b* represent alternate preferred embodiments of struts (10*a*) and (10*b*) respectively. Thus, offset struts (15) and (21) of struts (14) and (20) respectively may be aligned with members (21*a*) and (21*b*) and (15*a*) and (15*b*) rotated 180° to allow for either "2 by" or "4 by" support beam widths as an alternate to the use of adapter brackets (60) and (602) (see FIGS. 7A and 7B).

Device (10) can be easily installed in as little as five minutes. Device (10) is designed to be adjusted for any angular roof when used in a configuration set forth in FIG. 2. The roof could be anywhere from flat to a 12×12 (45°) pitch. The beams used to support device (10) may be anywhere from 2-inches×6-inches to 4-inches×12-inches.

To use scaffold device (10), simply take tension strut bracket (40) and slide it over the top of the roof rafter eaves between the rafter and the plywood or decking of the roof and nail the bracket to the rafter with two 80-pound duplex nails. Compression strut (14) is then rotated so it is aligned perpendicular to base member (12) and so that second end (18) of members (14*a*) and (14*b*) fit to either side of rafter. Compression strut bracket (36) then will fit against the underside face of the rafter. With compression strut bracket (36) pressed firmly against the underside, it should be nailed with two 80-pound duplex nails. All bolts are then tightened. The safety rail may then be installed, scaffold planks and safety ropes placed on the device. A second check should be made to ensure that all bolts and nails are fastened completely and locking pins are set. The scaffold device is now ready to use. One device will typically be used for every 8 linear feet.

Terms such as "left", "right", "up", "down", "bottom", "top", "front", "back", "in""out" and the like are applicable to the embodiment shown and described in conjunction with the drawings. These terms are merely for the purposes of description and do not necessarily apply to the position or manner in which the invention may be constructed or used.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A device for supporting a worker on scaffolding and attachable to a support member of a structure, the device comprising:

a base member with a first end, a second end and a body;

a compression strut with a first and a second end; said compression strut mountable to said base member.

a tension strut with a first end and a second end, said tension strut mountable to said base member;

a first bracket for attaching to said compression strut at the second end thereof and capable of securing said compression strut to a structure wherein said first bracket is articulably attached to a point on said compression strut so that said compression strut extends beyond said attachment point;

a second bracket for attaching to said tension strut to the structure;

means for attaching said compression strut to said base member; and means for attaching said tension strut to said base member, said means for attaching capable of attaching said tension strut to said base member in either an axis parallel to said base member or perpendicular to said base member;

wherein said compression strut and said tension strut are attached to said base member and the structure with said device then capable of carrying the weight of a worker.

2. The device of claim 1 wherein said compression strut is comprised of two similarly dimensioned members and wherein said first bracket is articulably attached to said compression strut.

3. The device of claim 1 wherein said tension strut is comprised of two similarly dimensioned members and said second bracket is articulably attached to said tension strut.

4. The device of claim 1 wherein said means for attaching said compression strut to said base member comprise means to rotatably attach said compression strut to said base member.

5. The device of claim 4 wherein said means for attaching said compression strut to said base member further comprises means to attach said compression strut in rigid, non-pivotable relation to said base member.

6. The device of claim 1 further comprising a safety rail and means for demountably attaching said safety rail to said base member at one end thereof.

7. The device of claim 1 wherein:

said compression strut is comprised of two members and said first bracket is articulably attached to said compression strut;

said tension strut is comprised of two members and said second bracket is articulably attached to said tension strut; said means for attaching said compression strut to said base member rotatably attach said compression strut to said base member; and said means for attaching said tension strut to said base member rotatably attach said tension strut to said base member.

8. The device of claim 7 further comprising a safety rail and means for demountably attaching said safety rail to said base member at one end thereof.

9. The device of claim 1 wherein said second bracket is articulably attached to said tension strut at the second end thereof so that said second bracket extends beyond the second end of said tension strut.

10. The device of claim 2 further comprising means integral with the members of said compression strut for adapting said compression strut for attaching to support members of various widths.

11. The device of claim 3 further comprising means integral with the members of said tension strut for adapting said tension strut for attaching to support members of various widths.

12. The device of claim 10 wherein said means for attaching said compression strut to said base member rotatably attaches said compression strut to said base member.

13. The device of claim 11 wherein said means for attaching said tension strut to said base member rotatably attaches said compression strut to said base member.

14. The device of claim 12 further comprising a safety rail and means for demountably attaching said safety rail to said base member at one end thereof.

15. The device of claim 13 further comprising a safety rail and means for demountably attaching said safety rail to said base member at one end thereof.

16. The device of claim 1 further comprising means for adapting said compression and said tension struts to support members of various widths.

17. The device of claim 1 further comprising means to secure said first bracket and said second bracket to the support members of the structure.

18. A method of using a scaffolding capable of being supported from a support beam of a building, the method comprising in the steps of:

providing a device having a base member, a compression strut, a tension strut, a first bracket for attaching said compression strut to the support beam of the building under construction wherein said first bracket is articulably attached to a point on said compression strut so that said compression strut extends beyond said attachment point, a second bracket for attaching the tension strut to a support member of the building under construction;

rotating said compression strut with respect to said base beam;

rotating said tension strut with respect to said base;

securing said compression strut to the support beam of said building such that it is loaded primarily under compression loading when weight is placed on the base beam;

securing said tension strut to the support beam of the building such that it is loaded primarily in tension when weight is applied to said base member; and nailing both said compression bracket and said tension bracket to the support beam.

19. A system capable of scaffolding a building by suspension from a support beam thereof, the system comprising a device comprised of:

a base member with a first end, a second end and a body;

a compression strut with a first and a second end; said compression strut mountable to said base member.

a tension strut with a first end and a second end, said tension strut mountable to said base member;

a first bracket for attaching to said compression strut at the second end thereof and capable of securing said compression strut to a structure wherein said first bracket is articulably attached to a point on said compression strut so that said compression strut extends beyond said attachment point;

means for attaching said compression strut to said base member; and means for attaching said tension strut to said base member, said means for attaching said tension strut to said base member in either an axis parallel to said base member or perpendicular to said base member; and a plank with means to secure said plank to the base member of said device.

* * * * *